US012703560B2

(12) United States Patent
Chen

(10) Patent No.: US 12,703,560 B2
(45) Date of Patent: Aug. 11, 2026

(54) ROTATABLE CONTAINER

(71) Applicant: YUYAO CAIYUN COSMETICS PACKAGING CO. LTD., Yuyao City (CN)

(72) Inventor: Jiabin Chen, Yuyao City (CN)

(73) Assignee: YUYAO CAIYUN COSMETICS PACKAGING CO. LTD., Yuyao City (CN)

( * ) Notice: Subject to any disclaimer, the term of this patent is extended or adjusted under 35 U.S.C. 154(b) by 270 days.

(21) Appl. No.: 18/419,957

(22) Filed: Jan. 23, 2024

(65) Prior Publication Data

US 2025/0145363 A1 May 8, 2025

(30) Foreign Application Priority Data

Nov. 6, 2023 (CN) ..... 202322985784.5
Dec. 15, 2023 (CN) ..... 202323427796.2

(51) Int. Cl.
*B65D 83/761* (2025.01)

(52) U.S. Cl.
CPC ..... *B65D 83/761* (2025.01)

(58) Field of Classification Search
CPC ..... B65D 83/761
USPC ..... 222/390
See application file for complete search history.

(56) References Cited

U.S. PATENT DOCUMENTS 5,292,203 A * 3/1994 Whitman ..... B65D 83/761 401/122
2010/0264172 A1* 10/2010 Nossbaum ..... B65D 83/761 222/386
2021/0061533 A1* 3/2021 Chen ..... B65D 77/0486
2021/0289918 A1* 9/2021 Thulin ..... A45D 40/16
2022/0395077 A1* 12/2022 Chen ..... A45D 40/16

* cited by examiner

*Primary Examiner* — Jeremy Carroll
(74) *Attorney, Agent, or Firm* — MUNCY, GEISSLER, OLDS & LOWE, P.C.

(57) ABSTRACT

A rotatable paste container is provided in the disclosure, which includes a paste box, a screw assembly and a rotating assembly. A first protrusion is formed at an outer side of a bottom of the paste box, and a sliding track is provided on the first protrusion, and a pit is provided on the sliding track. The rotating assembly includes a screw sleeve member and a rotating body. The screw sleeve member includes at least one support arm, and a sliding projection which is repeatedly engaged with the sliding track and the pit respectively is provided at a top of the at least one support arm, so that when the rotating assembly rotates relative to the paste box, the sliding projection is repeatedly engaged with the pit along the sliding track, thereby constantly controlling a rotation angle of the rotating body with a predetermined angle.

17 Claims, 10 Drawing Sheets

ROTATABLE CONTAINER

CROSS REFERENCE TO THE RELATED APPLICATIONS

This Non-provisional application claims priority under 35 U.S.C. § 119(a) on Chinese Patent Application No(s). CN 202323427796.2 filed on Dec. 15, 2023, and Chinese Patent Application No(s). CN 202322985784.5 filed on Nov. 6, 2023, the entire contents of which are hereby incorporated by reference.

TECHNICAL FIELD

The disclosure relates to the technical field of container packaging, in particular to a rotatable paste container.

BACKGROUND ART

For cosmetics such as lipstick, foundation, mascara, or daily chemicals such as glue stick, a new rotatable paste container can be used to facilitate carrying, which is clean and hygienic and can also reduce waste. A conventional rotatable paste container generally includes a housing, a container for containing paste, a rotating member that can rotate relative to the container for containing paste, and a moving member that moves up and down according to rotation of the rotating member. However, when this conventional paste container is used, the paste may suddenly move up and down due to a wrong operation by a user, for example suddenly protrude too much from the container, or suddenly retract into the container during use, thus causing inconvenience to the user.

For some paste bottles, a rotation angle of the paste container can be controlled through a rotating body that moves vertically and can control the rotation angle with a predetermined angle, so as to reduce occurrence probability of above problems, and a spring is adopted to cause the rotating body to rebound to its original position. If a metal spring is used, recycling is not facilitated, and if a plastic spring is used, resilience is not as good as that of the metal spring. Moreover, the metal spring or the plastic spring has a limited height in a vertical direction because the rotating body is required to move vertically, and thus a size of the limit structure used to accommodate the spring is more limited, and when the rotating body moves vertically, the spring is very easy to fall off, resulting in scrapping of the whole paste container.

SUMMARY

In order to overcome at least one shortcoming of related art, a rotatable paste container without an additional separate elastic member such as a spring and with a rotation angle controlled by a predetermined angle is provided in the disclosure.

In order to achieve at least one of above purposes, a paste container is provided in the disclosure, which includes a paste box, a screw assembly and a rotating assembly. A paste cavity for containing paste is provided in the paste box, a first protrusion is formed at an outer side of a bottom of the paste box, and a sliding track is provided on the first protrusion, and at least one pit is provided on the sliding track. The screw assembly includes a screw and a lifting platform provided at an end of the screw, and the screw assembly can be arranged in the paste box in a way of moving up and down, and the lifting platform is configured for receiving the paste. The rotating assembly includes a screw sleeve member and a rotating body. The rotating body is rotatably connected to the paste box, and the screw sleeve member is connected to inside of the rotating body so that the rotating body and the screw sleeve member rotate together. The screw sleeve member includes at least one support arm, and a sliding projection which is repeatedly matched with the sliding track and the pit respectively is provided at a top of the at least one support arm, so that when the rotating assembly rotates relative to the paste box, the sliding projection is repeatedly engaged with the pit along the sliding track, thereby constantly controlling a rotation angle of the rotating body with a predetermined angle.

Alternatively, a hollow vertical cylinder extending upwards is formed at a center of the screw sleeve member, and a thread structure for matching with threads outside the screw is provided on an inner wall of an upper end of the hollow vertical cylinder, so that the hollow vertical cylinder and the screw can in threaded connection to drive the screw to move up and down.

Alternatively, at least one first fastening rib is circumferentially provided on an inner wall of the first protrusion, and at least one first limiting step is provided at a middle of an outer wall of the hollow vertical cylinder, so that after the hollow vertical cylinder is inserted into the first protrusion to be in threaded connection with the screw, the at least one first fastening rib and the at least one first limiting step cooperate with each other. The first protrusion may be of a hollow cylindrical structure.

Alternatively, at least one second fastening rib is circumferentially provided on the outer wall of the first protrusion, and a through hole for the screw sleeve member to pass through is provided at a center of the rotating body, and the second fastening rib and the through hole are matched with each other.

Alternatively, a second limiting step is provided at an upper end of the screw, and at least one third limiting step matched with the second limiting step for limiting rotation of the rotating assembly is circumferentially provided on an inner wall of the hollow vertical cylinder.

Alternatively, a straight line or a curve extends between a lowest point of a concave base and a highest point of a convex head, adjacent to the concave base, of the undulating track.

Alternatively, the screw is of a hollow structure, thus with a reduced thickness, reduced shrinkage during injection molding and reduced difficulty of injection molding.

Alternatively, the rotating body is provided with at least one positioning boss for matching with at least one positioning groove at the bottom of the paste box.

Alternatively, the paste container further includes a top cover, a bottom cover and a paste inner cover. The paste inner cover is placed on an upper part of a cavity of the paste box. The top cover is clamped with the rotating body through the fastening ribs and steps, and the bottom cover is clamped with the rotating body through the fastening ribs.

Alternatively, the paste container is in a flat shape as a whole, for example with an oval cross section, or a cross section in a shape combining oval and rectangle shapes or in other shapes, so as to facilitate rotation.

Alternatively, the sliding track is circumferentially arranged on an outer wall of the first protrusion, and two or more than two pits are symmetrically arranged on the sliding track, and a depth of each pit is different from a depth of the sliding track, or a diameter of the pit is different from a track width of the sliding track, or the depth of each pit is different from the depth of the sliding track and the diameter of the pit is different from the track width of the sliding track. When there are two pits, corresponding effect may be produced when the pits are rotated at 180 degrees or 360 degrees or 90 degrees. If there are more pits, a rotation angle varies accordingly.

Alternatively, there are two or more than two sliding tracks, which are circumferentially and symmetrically arranged on an outer wall of the first protrusion, and pits are respectively arranged on both sides of each sliding track, and the pits are arranged between two adjacent sliding tracks, and the sliding tracks are not communicated with the pits. When there are two sliding tracks, corresponding effect may be produced when the sliding track rotates at 180 degrees or 360 degrees or 90 degrees. If there are more sliding tracks, the rotation angle may vary accordingly, such as 30 degrees, 60 degrees and so on.

Alternatively, the screw sleeve member includes a bottom plate, a hollow vertical cylinder extending upward is formed at a center of the screw sleeve member and from the bottom plate, the at least one support arm extends upward from both sides of the hollow vertical cylinder and from the bottom plate, and a sliding projection repeatedly engaged with the sliding track and the pit is provided at a position on a top end of the support arm facing a hollow vertical cylinder.

Alternatively, a sinking platform is provided around the pit, a width of the sinking platform is larger than that of the sliding track, a depth of the sinking platform is similar to or equal to that of the sliding track, and a depth of the pit is larger than that of the sliding track.

Alternatively, at least one side plate extends upward from both sides of the hollow vertical cylinder and from the bottom plate, the support arm is arranged between the side plate and the hollow vertical cylinder, a groove is remained between the side plate and the support arm, and the sliding projection is of a semi-spherical structure.

To sum up, for the paste container according to this disclosure, its rotation angle can be controlled and it is smooth to use. Moreover, instead of being provided with an additional elastic member such as a spring, the paste container according to this disclosure is provided with the sliding projection at the top of the support arm to be repeatedly engaged with the sliding track and the pit respectively, so that when the rotating assembly rotates relative to the paste box, the top plate is repeatedly engaged with the pit along the sliding track, thus constantly controlling the rotation angle of the rotating body with the predetermined angle.

Further, all of parts are made of plastic, which facilitates recycling, is more environmentally friendly and energy-saving, and further facilitates reducing product costs.

DETAILED DESCRIPTION

Figure 1:
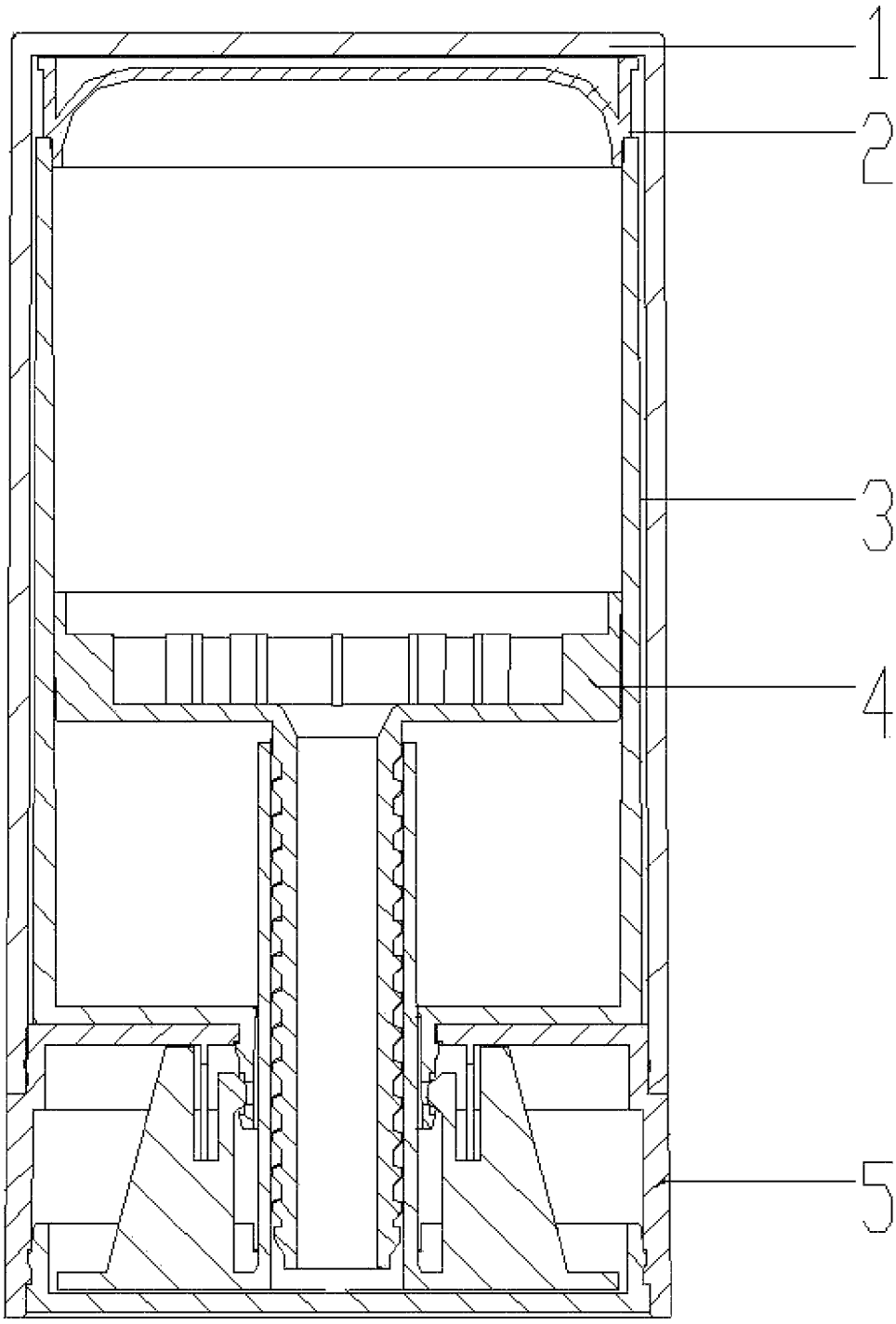
FIG. 1 is a schematic cross-sectional view of a paste container according to an embodiment of the present disclosure.
Figure 2:
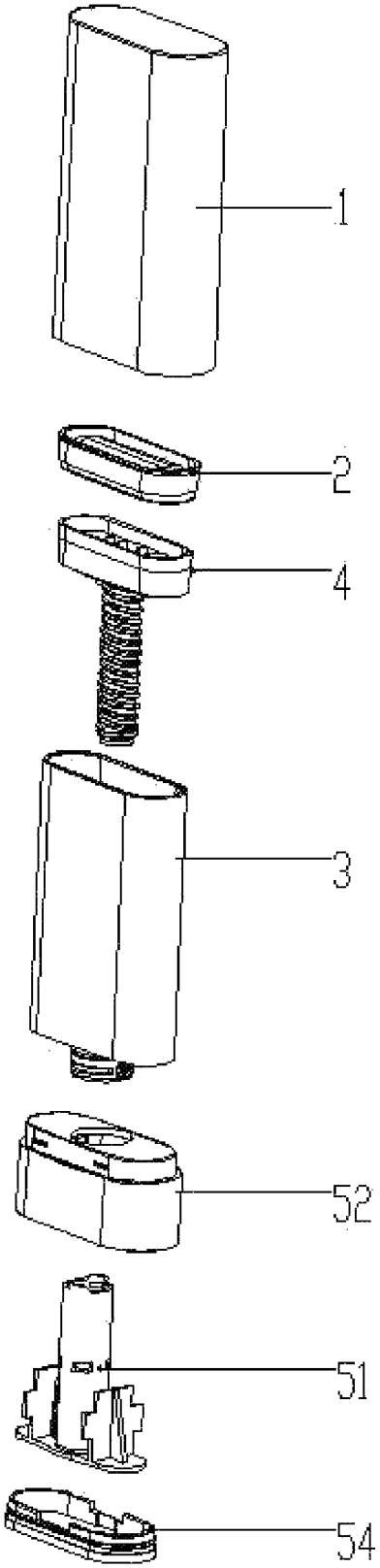
FIG. 2 is a schematic exploded view of a paste container according to an embodiment of the disclosure.
Figure 3:
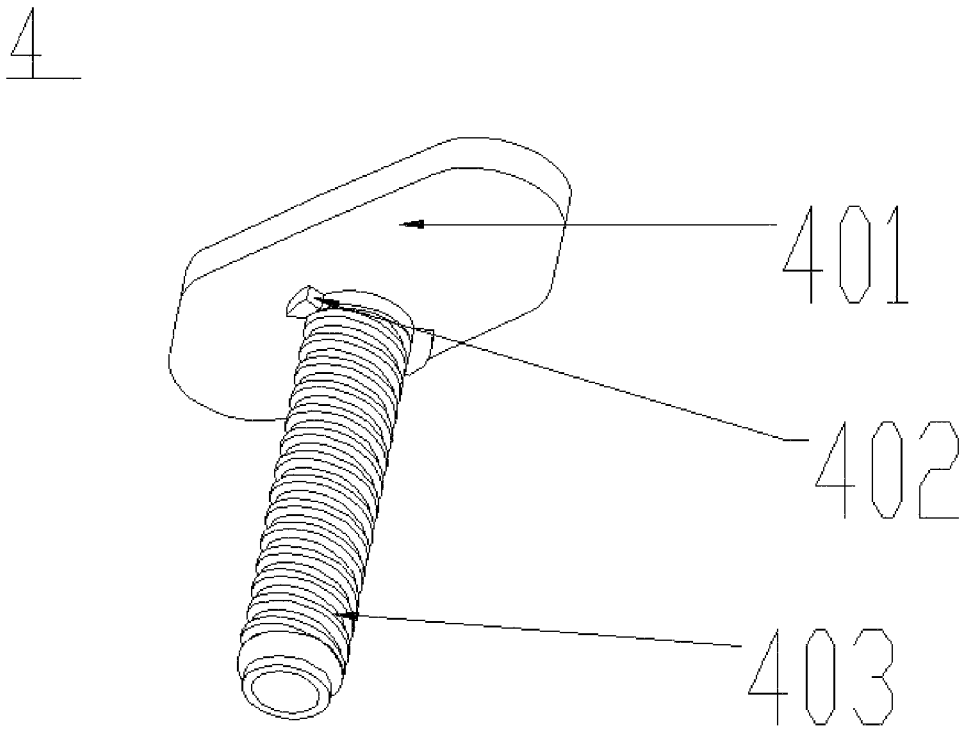
FIG. 3 is a schematic view of a screw assembly according to an embodiment of the present disclosure.
Figure 4:
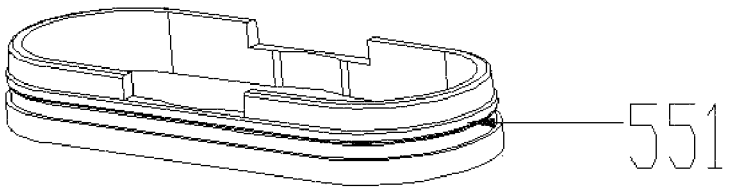
FIG. 4 is a schematic view of a bottom cover according to an embodiment of the present disclosure.

In order to make the above and other objects, features and advantages of the disclosure more obvious and understandable, a detailed description is made below for the preferred embodiments with reference to the accompanying drawings.

Referring to FIG. 1 to FIG. 11, a paste container is provided in this disclosure, which includes a paste box 3, a screw assembly 4 and a rotating assembly 5. A paste cavity 304 for containing paste is provided in the paste box, a first protrusion 306 is formed at an outer side of a bottom of the paste box, and a sliding track 301 is provided on the first protrusion, and at least one pit 307 is provided on the sliding track. The screw assembly includes a screw 403 and a lifting platform 401 provided at an end of the screw, and the screw assembly can be arranged in the paste box in a way of moving up and down, and the lifting platform is configured for receiving the paste. The rotating assembly includes a screw sleeve member 51 and a rotating body 52. The rotating body is rotatably connected to the paste box, and the screw sleeve member is connected to inside of the rotating body so that the rotating body and the screw sleeve member rotate together. The screw sleeve member includes at least one support arm 517, and a sliding projection 518 which is repeatedly matched with the sliding track and the pit respectively is provided at a top of the at least one support arm, so that when the rotating assembly rotates relative to the paste box, the sliding projection is repeatedly engaged with the pit along the sliding track, thereby constantly controlling a rotation angle of the rotating body with a predetermined angle.

In this embodiment, the first protrusion 306 can be of a hollow cylindrical structure, and in other embodiments, the first protrusion can be of other shapes and structures. One or more second fastening ribs 302 are circumferentially arranged on an outer wall of the first protrusion, and a through hole 524 for the screw sleeve member to pass through is provided at a center of the rotating body, and the second fastening rib and the through hole are matched with each other. There is further a sliding track 301 provided at a position where the second fastening rib 302 is far away from the paste cavity 304 of the paste box 3 (that is, near an edge of the first protrusion 306). The sliding track 301 is circumferentially arranged on the outer wall of the first protrusion, and there is no need to provide an undulating track in shape, that is, the sliding track 301 can be arranged in parallel with the second fastening rib 302, and the sliding track 301 does not need to have a convex head and a concave base of the undulating track. The sliding track 301 is configured to be matched with the sliding projection 518 of the screw sleeve member 51.

A pair of pits 307 are symmetrically arranged on the sliding track 301, and a depth of each pit is different from that of the sliding track, and a diameter of the pit is different from that of the sliding track, so that undulating and staggered feeling can be realized, and thus a hand feeling or sensation as well as positioning effect can be given to the user when the paste box rotates by 90 degrees or 180 degrees. In other embodiments, only the depth of the pit is different from the depth of the sliding track, or only the diameter of the pit is different from a track width of the sliding track.

When the depth of the sliding track is different from that of the pit, height difference can be generated, which can provide a more obvious hand feeling or sensation as well as positioning effect. As an option, the sliding projection has been elastically deformed in the sliding track, and after the sliding projection rises from the sliding track along the protrusion, it quickly falls to a bottom of the pit, with increased height difference in this process; and under action of elastic recovery, the sliding projection hits the bottom of the pit, thus with an obvious hand feeling. The same is applied to a case that the track width of the sliding track is different from the width of the pit.

Figure 8:
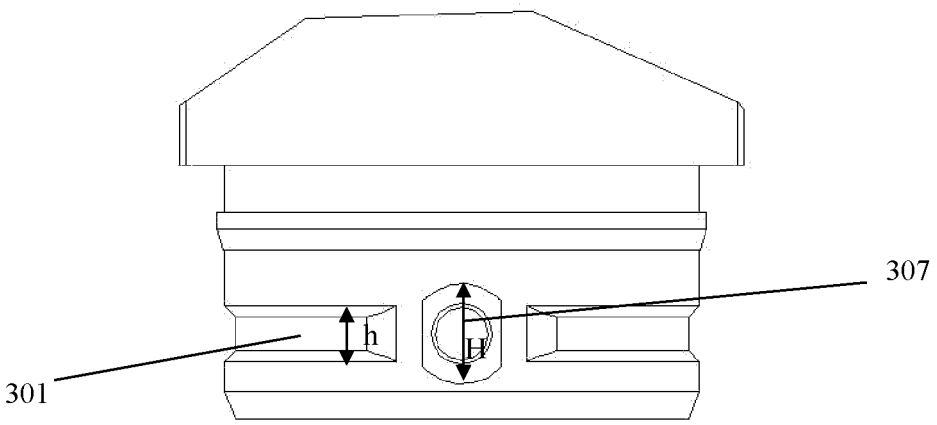
FIG. 8 is a partial enlarged view of a first protrusion according to an embodiment of the present disclosure from another perspective.

In another embodiment, as shown in FIG. 8, a back surface of the first protrusion is symmetrical to a part shown in FIG. 8, and thus there are two sliding tracks, which are symmetrically and circumferentially arranged on the outer wall of the first protrusion. A pit is provided between the sliding tracks, there are two pits 307, and the other pit is located on the back surface of the first protrusion (not shown in FIG. 8), and the sliding track is not communicated with the pit. Therefore, when the sliding track is transitioned to the pit or the pit is transitioned to the sliding track, a height difference exists, so that a more obvious hand feeling or sensation and positioning effect exist at a moment when sliding is made from the sliding track to the pit. Just like pressing a switch, when hearing "snap", it can be known that the switch has been pressed.

Figure 11:
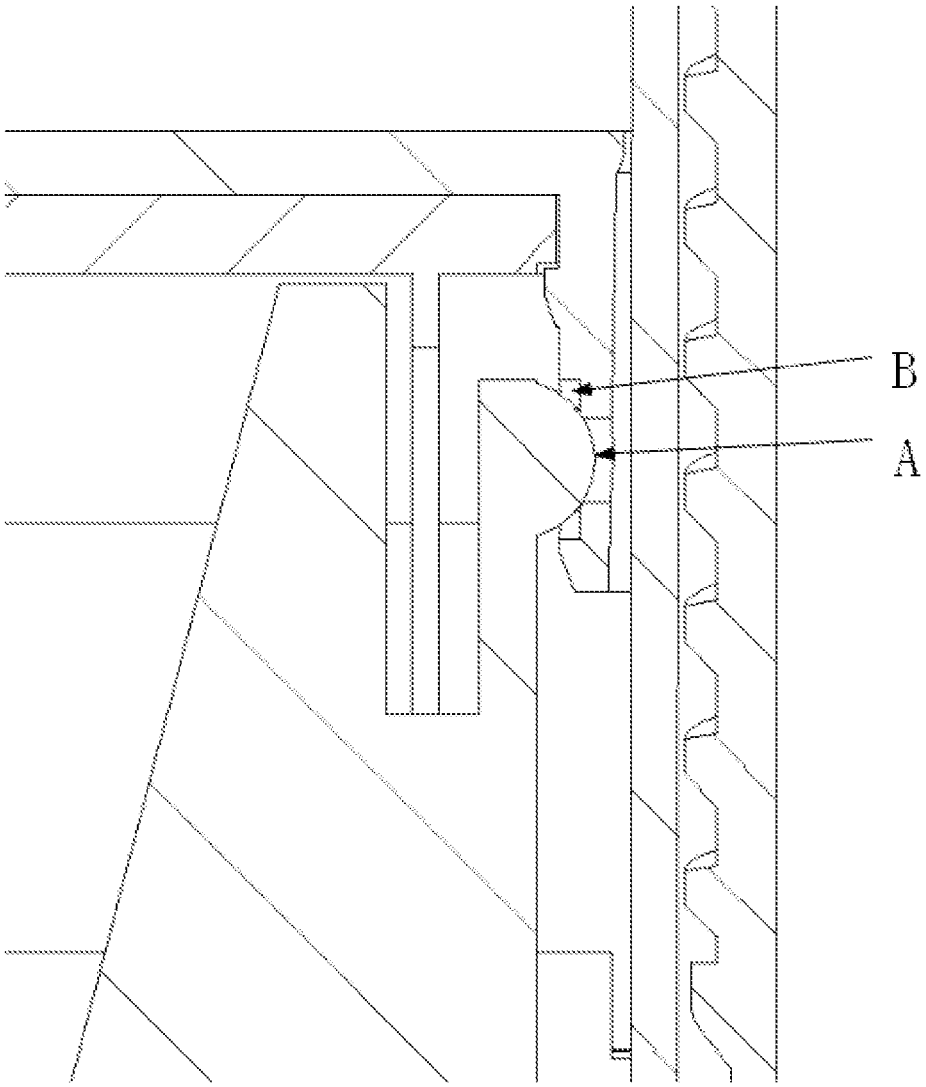
FIG. 11 is a schematic view of matching of a sliding projection and a pit according to an embodiment of the present disclosure.

Alternatively, a sinking platform 309 is provided around the pit, a width H of the sinking platform is larger than a width h of the sliding track. In this way, contact between the sliding projection and the bottom of the pit can be minimized, and possible secondary contact generated can be reduced. As shown in FIG. 11, a region A (a top of the sliding projection) of the hemispherical sliding projection proximate to its top surface is contacted with the pit (for example, the bottom of the pit and/or a side wall of the pit) as far as possible, while secondary contact of the sliding projection at a position B (a position where the sliding projection faces the sinking platform) is avoided, that is, the sliding projection is not contacted with the sinking platform, which affects the hand feeling and performance.

Alternatively, a depth of the sinking platform is similar to or equal to that of the sliding track, and a depth of the pit is larger than that of the sliding track.

Figure 5:
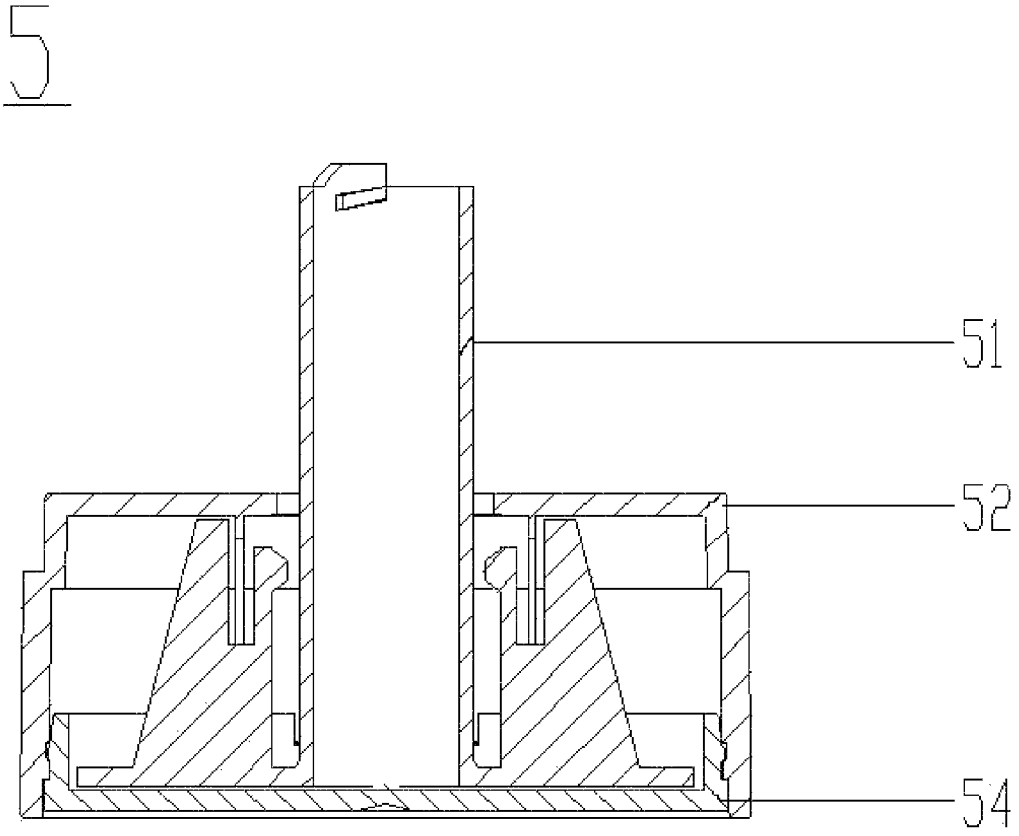
FIG. 5 is a schematic cross-sectional view of a rotating assembly according to an embodiment of the present disclosure.
Figure 9:
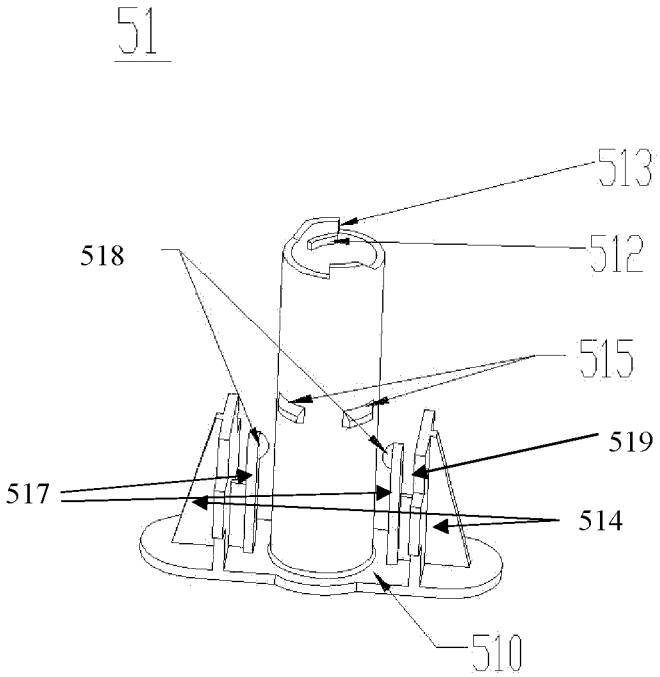
FIG. 9 is a schematic view of a screw sleeve member according to an embodiment of the present disclosure.

In this embodiment, many functions are integrated in the screw sleeve member 51, thus greatly reducing complexity of the whole container device. As shown in FIGS. 5 and 9, a hollow vertical cylinder extending upwards is formed at a center of the screw sleeve member, and a thread structure 512 for matching with threads outside the screw is provided on an inner wall of an upper end of the hollow vertical cylinder, so that the hollow vertical cylinder and the screw can in threaded connection to drive the screw to move up and down.

A pair of side plates 514 extend upward from both sides of the hollow vertical cylinder and from the bottom plate 510, and support arm 517 extends upward from between the side plates 514 and the hollow vertical cylinder. A sliding projection 518 is provided at a position on a top end of a respective support arm facing the hollow vertical cylinder, and there can be two support arms, which are respectively located between the opposite side plates 514 and the hollow vertical cylinder. A connecting part may be provided between a side plate 514 and the support arm 517 to increase strength of the support arm. The connecting part may be shorter than both the side plate 514 and the support arm 517, or the connecting part may be flush with the side plate 514 or the support arm 517. When the connecting part is shorter than both the side plate 514 and the supporting arm 517, that is, a groove 519 is remained between the side plate and the supporting arm, the whole structure can be ensured to have certain elasticity to adapt to change in a height (depth) of a contact surface between the sliding projection 518 and the sliding track/pit of the paste box. Each side plate may be a ribbed plate including a cross.

In other embodiments, the pair of side plates 514 may not be provided, that is, the support arm 517 may directly extend upward from the bottom plate.

The sliding projection 518 on the support arm 517 cooperates with the sliding track 301 and the pit 307, thereby achieving effect in the above embodiment. The sliding projection 518 may be of a semi-spherical structure, which functions in controlling rotation and generating rotation feeling. The pit is matched with the sliding projection in shape and size.

Figure 12:
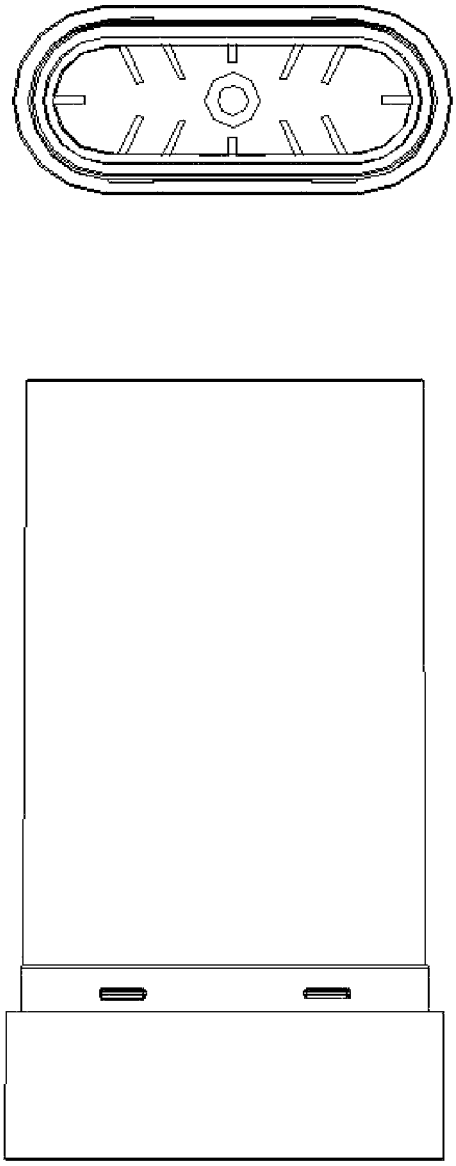
FIG. 12 is a top view and a front view of a paste container according to an embodiment of the present disclosure when it is not rotated (in a natural state)

When the paste container is not rotated (in a natural state), in a state as shown in FIG. 12, the sliding projections 518 are just abutted against and in contact with the pits 307 on both sides of the sliding track 301 at a lower end of the paste box 3.

Figure 13:
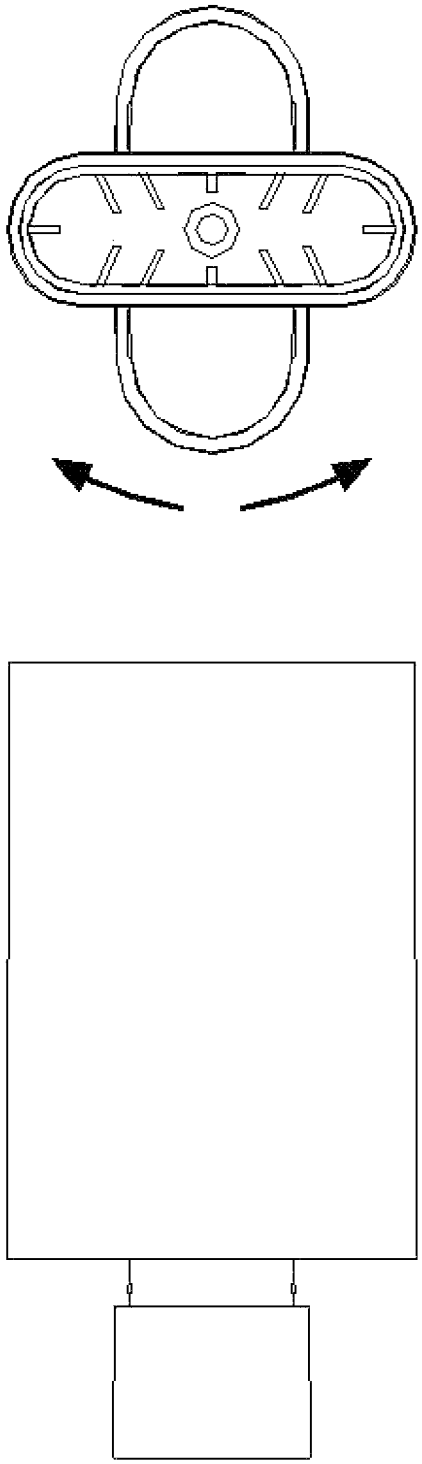
FIG. 13 is a top view and a front view of a paste container according to an embodiment of the present disclosure when it is rotated in use.

When the paste container is rotated in use, when the rotating assembly 5 is rotated counterclockwise as shown in FIG. 13, the screw sleeve member 51 rotates relative to the paste box. During rotation, the sliding projection 518 on the screw sleeve member 51 for controlling the rotation moves along the sliding track 301 at the lower end of the paste box; and after rotating by 180 degrees, the two semi-spherical sliding projections 518 of the screw sleeve member 51 come into contact with the pits 307 on both sides of the sliding track 301 at the lower end of the paste box again, thus generating rotation feeling. Then, the screw sleeve member is continued to rotating counterclockwise, when the rotating assembly 5 rotates by 180 degrees as a whole, the rotating assembly 5 returns to a state of rotating in use. During the rotation, the screw assembly 4 moves upward along the screw sleeve member 51 (external thread on the screw is meshed with the thread on the screw sleeve member). The thread is left-handed thread. When the screw sleeve member rotates counterclockwise as shown, the screw sleeve member only moves in rotation, thus pushing the screw upward. When the rotating assembly 5 is continuously rotated counterclockwise, the screw assembly 4 continues to moving upward, and material in the paste box moves upward.

During use, if the rotating assembly 5 is rotated clockwise as shown in FIG. 13, the screw assembly 4 moves downward along the screw sleeve member 51. Then, the rotating assembly is continued to rotate clockwise, when the rotating assembly 5 rotates by 180 degrees or 360 degrees as a whole, the rotating assembly 5 returns to an appearance state as shown in FIG. 13. During rotation, the sliding projection 518 on the screw sleeve member 51 for controlling the rotation moves along the sliding track 301 at the lower end of the paste box, and this sliding projection 518 is abutted against and in contact with the pit 307 at the lower end of the paste box every time the rotating assembly rotates by 180 degrees, thus generating rotation feeling. Similarly, when the screw sleeve member rotates clockwise as shown, the screw sleeve drives the screw to move down.

When the screw assembly 4 moves down to a bottom, a step 402 on the screw assembly 4 is in contact with a step 515 on an upper part of the screw sleeve member 51 so as to limit the rotation. At this time, the rotating assembly 5 cannot be continued to rotating clockwise.

In other embodiments, setting of clockwise rotation and counterclockwise rotation can be reversed.

Figure 10:
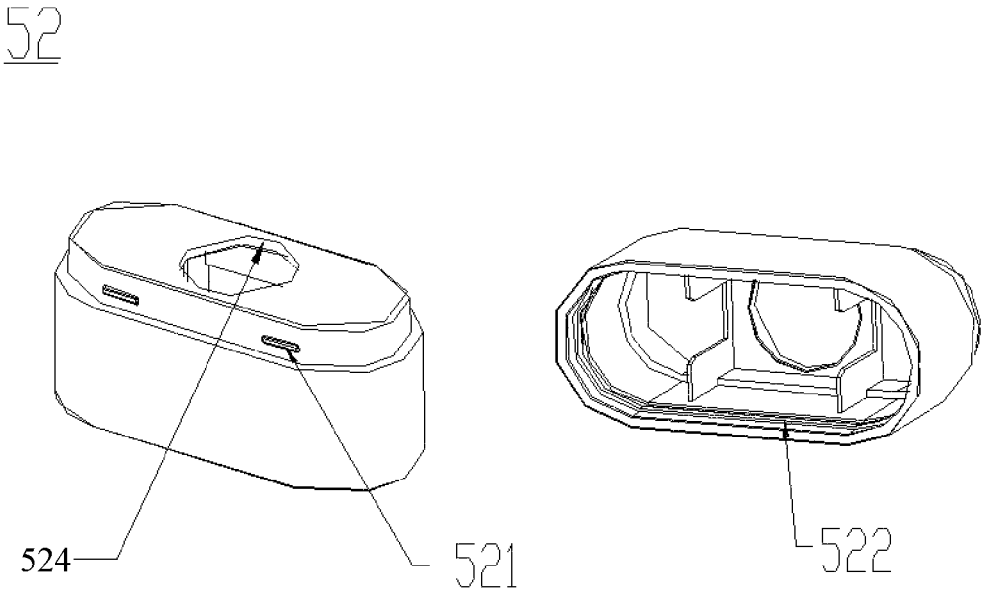
FIG. 10 is a schematic view of a rotating body according to an embodiment of the present disclosure.

Although it can be seen from a schematic view from the bottom shown on the right of FIG. 10 that a pair of U-shaped parallel clamping plates are provided on the rotating body, this pair of clamping plates may not be provided in schemes of this disclosure, which is not limited herein.

Figure 6:
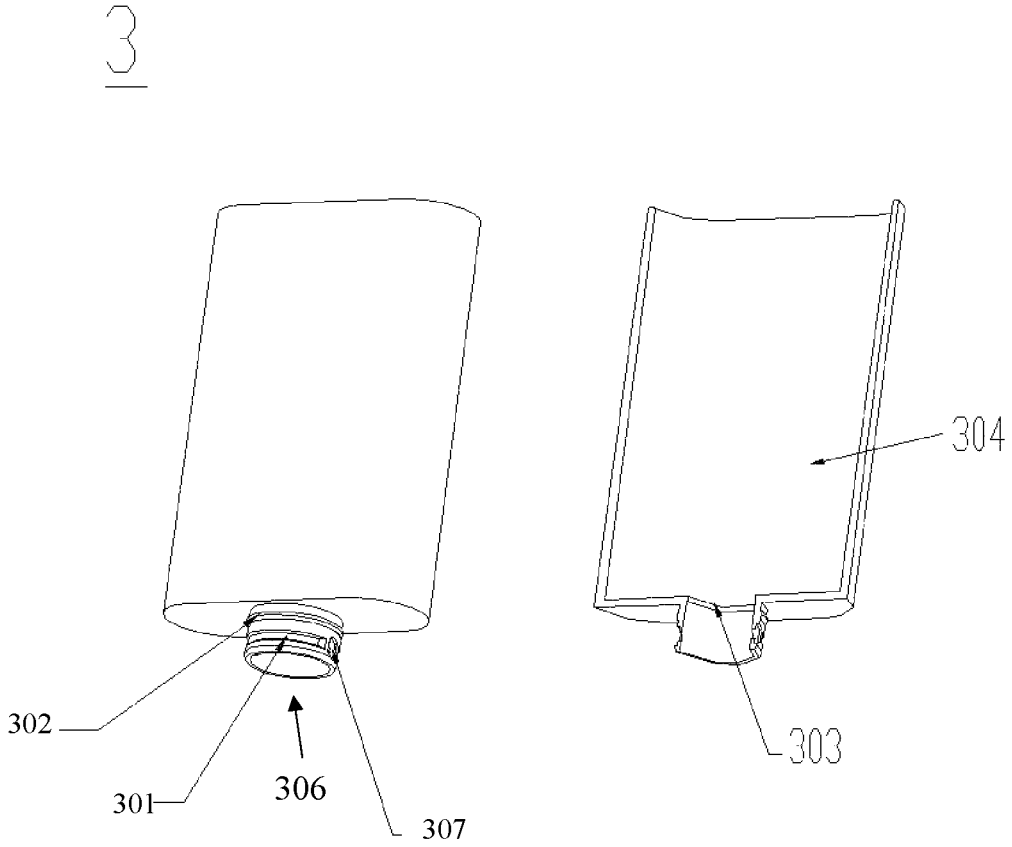
FIG. 6 is a schematic view of a paste box according to an embodiment of the present disclosure.
Figure 7:
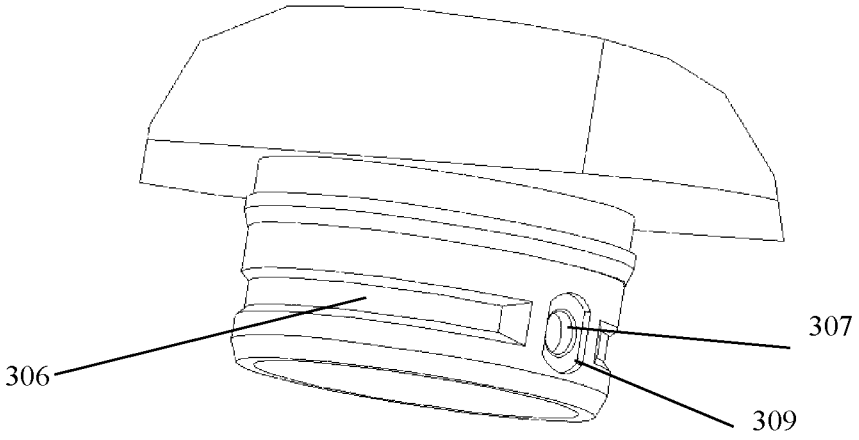
FIG. 7 is a partial enlarged view of a first protrusion according to an embodiment of the present disclosure.

In this embodiment, as shown in FIG. 6, which, from left to right, shows a schematic view of a paste box and a schematic view of the paste box body after being cut in half, a first fastening rib 303 is circumferentially provided on an inner wall of the first protrusion, and two first limiting steps 515 are provided at a middle of an outer wall of the hollow vertical cylinder, and the two first limiting steps 515 are formed from projections of the hollow vertical cylinder, and the screw structure 512 is arranged at an inner side of the first limiting steps, so that after the hollow vertical cylinder is inserted into the first protrusion to be in threaded connection with the screw, the at least one first fastening rib and the at least one first limiting step cooperate with each other.

In this embodiment, a second fastening rib 302 is circumferentially provided on the outer wall of the first protrusion, and a through hole 524 for the screw sleeve member to pass through is provided at a center of the rotating body, and the second fastening rib 302 and the through hole 524 are matched with each other.

In this embodiment, a second limiting step 402 is provided at an upper end of the screw, and two third limiting steps 513 matched with the second limiting step for limiting rotation of the rotating assembly are circumferentially provided at a position on an inner wall of the hollow vertical cylinder proximate to the top end.

In other embodiments, numbers of the first limit step, the second limit step and the third limit step can be set in any manner, such as one, two, three and so on.

In this embodiment, as shown in FIG. 10, which, from left to right, respectively shows two schematic views of the rotating body from two perspectives, with the left showing a schematic view from the top (obliquely above) and the right showing a schematic view from the bottom, the rotating body may be provided with a positioning structure opposite to the bottom of the paste box, which is not limited herein. In this embodiment, the paste container may further include a top cover 1, a bottom cover 54 and a paste inner cover 2. The paste inner cover is placed on an upper part of a cavity of the paste box. The top cover is clamped with the rotating body through a fastening rib 521 and the steps, and the bottom cover is clamped with the rotating body through fastening ribs 522 and 551.

In this embodiment, the top cover 1, the paste inner cover 2, the screw assembly 4 and the bottom cover 54 can all be components with other shapes and structures available commercially at present. The screw sleeve member 51 and the rotating body 52 of the rotating assembly 5 can also be components with other shapes and structures available commercially.

It should be understood by those skilled in the art that in the disclosure of the present disclosure, the orientation or positional relationship indicated by the terms "upper", "lower", "front", "rear", "left", "right", "vertical", "horizontal", "top", "bottom", "inner", "inner" and the like is based on the orientation or positional relationship shown in the drawings, which is only for the convenience of describing the disclosure and simplifying the description, but does not indicate or imply that the referred device or element must have a specific orientation, be constructed and operated in a specific orientation, and thus the above terms cannot be understood as limiting the disclosure.

Although the disclosure has been disclosed by the preferred embodiment in the above, it is not intended to limit the disclosure and any person familiar with the art can make some changes and embellishments without departing from the spirit and scope of the disclosure; therefore, the scope of protection of the disclosure should be subject to a scope of protection as claimed in the claims.

The invention claimed is:

1. A rotatable paste container, comprising:

a paste box in which a paste cavity for containing paste is provided, a first protrusion being formed at an outer side of a bottom of the paste box, and a sliding track being provided on the first protrusion, and at least one pit being provided at or beside the sliding track, a screw assembly comprising a screw and a lifting platform provided at an end of the screw, the screw assembly being arranged inside the paste box in a way of moving up and down, and the lifting platform being configured for receiving the paste; and a rotating assembly comprising a screw sleeve member and a rotating body, the rotating body being rotatably connected to the paste box and the screw sleeve member being connected to inside of the rotating body so that the rotating body and the screw sleeve member rotate together;

wherein the screw sleeve member comprises at least one support arm, a sliding projection which is repeatedly matched with the sliding track and the pit respectively being provided at a top of the at least one support arm, so that when the rotating assembly rotates relative to the paste box, the sliding projection is repeatedly engaged with the pit along the sliding track and the pit, thereby constantly controlling a rotation angle of the rotating body with a predetermined angle;

wherein a hollow vertical cylinder extending upwards is formed at a center of the screw sleeve member, and a thread structure for matching with threads outside the screw is provided on an inner wall of an upper end of the hollow vertical cylinder, so that the hollow vertical cylinder and the screw can in threaded connection to drive the screw to move up and down;

wherein at least one first fastening rib is circumferentially provided on an inner wall of the first protrusion, and at least one first limiting step is provided at a middle of an outer wall of the hollow vertical cylinder, so that after the hollow vertical cylinder is inserted into the first protrusion to be in threaded connection with the screw, the at least one first fastening rib and the at least one first limiting step cooperate with each other;

wherein a second limiting step is provided at an upper end of the screw, and at least one third limiting step matched with the second limiting step for limiting rotation of the rotating assembly is circumferentially provided on an inner wall of the hollow vertical cylinder.

2. The rotatable paste container according to claim 1, wherein at least one second fastening rib is circumferentially provided on an outer wall of the first protrusion, and a through hole for the screw sleeve member to pass through is provided at a center of the rotating body, and the second fastening rib and the through hole are matched with each other.

3. The rotatable paste container according to claim 2, wherein the sliding track is circumferentially arranged on an outer wall of the first protrusion, and two or more than two pits are symmetrically arranged on or beside the sliding track; and a depth of each pit is different from a depth of the sliding track, or a diameter of the pit is different from a track width of the sliding track, or the depth of each pit is different from the depth of the sliding track and the diameter of the pit is different from the track width of the sliding track.

4. The rotatable paste container according to claim 2, wherein there are two or more than two sliding tracks, which are circumferentially and symmetrically arranged on an outer wall of the first protrusion, and pits are respectively arranged on both sides of each sliding track, and the pits are arranged between two adjacent sliding tracks, and the sliding tracks are not communicated with the pits.

5. The rotatable paste container according to claim 4, wherein the screw sleeve member comprises a bottom plate, a hollow vertical cylinder extending upward is formed at a center of the screw sleeve member and from the bottom plate, the at least one support arm extends upward from both sides of the hollow vertical cylinder and from the bottom plate, and a sliding projection repeatedly engaged with the sliding track and the pit is provided at a position on a top end of the support arm facing a hollow vertical cylinder.

6. The rotatable paste container according to claim 5, wherein at least one side plate extends upward from both sides of the hollow vertical cylinder and from the bottom plate, the support arm is arranged between the side plate and the hollow vertical cylinder, a groove is remained between the side plate and the support arm, and the sliding projection is of a semi-spherical structure.

7. The rotatable paste container according to claim 2, wherein the paste container further comprises a top cover, a bottom cover and a paste inner cover, the paste inner cover being placed on an upper part of a cavity of the paste box, the top cover being clamped with the rotating body through the fastening ribs and steps, and the bottom cover being clamped with the rotating body through the fastening ribs.

8. The rotatable paste container according to claim 1, wherein the paste container further comprises a top cover, a bottom cover and a paste inner cover, the paste inner cover being placed on an upper part of a cavity of the paste box, the top cover being clamped with the rotating body through the fastening ribs and steps, and the bottom cover being clamped with the rotating body through the fastening ribs.

9. The rotatable paste container according to claim 1, wherein the sliding track is circumferentially arranged on an outer wall of the first protrusion, and two or more than two pits are symmetrically arranged on or beside the sliding track; and a depth of each pit is different from a depth of the sliding track, or a diameter of the pit is different from a track width of the sliding track, or the depth of each pit is different from the depth of the sliding track and the diameter of the pit is different from the track width of the sliding track.

10. The rotatable paste container according to claim 9, wherein there are two or more than two sliding tracks, which are circumferentially and symmetrically arranged on an outer wall of the first protrusion, and pits are respectively arranged on both sides of each sliding track, and the pits are arranged between two adjacent sliding tracks, and the sliding tracks are not communicated with the pits.

11. The rotatable paste container according to claim 10, wherein the screw sleeve member comprises a bottom plate, a hollow vertical cylinder extending upward is formed at a center of the screw sleeve member and from the bottom plate, the at least one support arm extends upward from both sides of the hollow vertical cylinder and from the bottom plate, and a sliding projection repeatedly engaged with the sliding track and the pit is provided at a position on a top end of the support arm facing a hollow vertical cylinder.

12. The rotatable paste container according to claim 11, wherein at least one side plate extends upward from both sides of the hollow vertical cylinder and from the bottom plate, the support arm is arranged between the side plate and the hollow vertical cylinder, a groove is remained between the side plate and the support arm, and the sliding projection is of a semi-spherical structure.

13. The rotatable paste container according to claim 9, wherein the paste container further comprises a top cover, a bottom cover and a paste inner cover, the paste inner cover being placed on an upper part of a cavity of the paste box, the top cover being clamped with the rotating body through the fastening ribs and steps, and the bottom cover being clamped with the rotating body through the fastening ribs.

14. A rotatable paste container, comprising:

a paste box in which a paste cavity for containing paste is provided, a first protrusion being formed at an outer side of a bottom of the paste box, and a sliding track being provided on the first protrusion, and at least one pit being provided at or beside the sliding track, a screw assembly comprising a screw and a lifting platform provided at an end of the screw, the screw assembly being arranged inside the paste box in a way of moving up and down, and the lifting platform being configured for receiving the paste; and a rotating assembly comprising a screw sleeve member and a rotating body, the rotating body being rotatably connected to the paste box and the screw sleeve member being connected to inside of the rotating body so that the rotating body and the screw sleeve member rotate together; wherein the screw sleeve member comprises at least one support arm, a sliding projection which is repeatedly matched with the sliding track and the pit respectively being provided at a top of the at least one support arm, so that when the rotating assembly rotates relative to the paste box, the sliding projection is repeatedly engaged with the pit along the sliding track and the pit, thereby constantly controlling a rotation angle of the rotating body with a predetermined angle;

wherein the sliding track is circumferentially arranged on an outer wall of the first protrusion, and two or more than two pits are symmetrically arranged on or beside the sliding track; and a depth of each pit is different from a depth of the sliding track, or a diameter of the pit is different from a track width of the sliding track, or the depth of each pit is different from the depth of the sliding track and the diameter of the pit is different from the track width of the sliding track.

15. A rotatable paste container, comprising:

a paste box in which a paste cavity for containing paste is provided, a first protrusion being formed at an outer side of a bottom of the paste box, and a sliding track being provided on the first protrusion, and at least one pit being provided at or beside the sliding track, a screw assembly comprising a screw and a lifting platform provided at an end of the screw, the screw assembly being arranged inside the paste box in a way of moving up and down, and the lifting platform being configured for receiving the paste; and a rotating assembly comprising a screw sleeve member and a rotating body, the rotating body being rotatably connected to the paste box and the screw sleeve member being connected to inside of the rotating body so that the rotating body and the screw sleeve member rotate together; wherein the screw sleeve member comprises at least one support arm, a sliding projection which is repeatedly matched with the sliding track and the pit respectively being provided at a top of the at least one support arm, so that when the rotating assembly rotates relative to the paste box, the sliding projection is repeatedly engaged with the pit along the sliding track and the pit, thereby constantly controlling a rotation angle of the rotating body with a predetermined angle;

wherein there are two or more than two sliding tracks, which are circumferentially and symmetrically arranged on an outer wall of the first protrusion, and pits are respectively arranged on both sides of each sliding track, and the pits are arranged between two adjacent sliding tracks, and the sliding tracks are not communicated with the pits.

16. The rotatable paste container according to claim 15, wherein the screw sleeve member comprises a bottom plate, a hollow vertical cylinder extending upward is formed at a center of the screw sleeve member and from the bottom plate, the at least one support arm extends upward from both sides of the hollow vertical cylinder and from the bottom plate, and a sliding projection repeatedly engaged with the sliding track and the pit is provided at a position on a top end of the support arm facing a hollow vertical cylinder.

17. The rotatable paste container according to claim 16, wherein at least one side plate extends upward from both sides of the hollow vertical cylinder and from the bottom plate, the support arm is arranged between the side plate and the hollow vertical cylinder, a groove is remained between the side plate and the support arm, and the sliding projection is of a semi-spherical structure.

* * * * *